US006823553B1

(12) United States Patent
Paredes

(10) Patent No.: US 6,823,553 B1
(45) Date of Patent: Nov. 30, 2004

(54) PAINTBRUSH AND CAN OPENER COMBINATION

(76) Inventor: Alfred E. Paredes, 1891 Fairview Pl., Pomona, CA (US) 91768

( * ) Notice: Subject to any disclaimer, the term of this patent is extended or adjusted under 35 U.S.C. 154(b) by 0 days.

(21) Appl. No.: 10/733,887

(22) Filed: Dec. 12, 2003

(51) Int. Cl.[7] ..... A46B 5/00; B25F 1/00

(52) U.S. Cl. ..... 15/105; 15/111; 7/105; 7/151; 81/3.55; D4/116

(58) Field of Search ..... 15/105, 111; 7/105, 7/151; 81/3.09, 3.55; D4/116, 118

(56) References Cited

U.S. PATENT DOCUMENTS

| | | | | | |
|---|---|---|---|---|---|
| 122,186 | A | * | 12/1871 | Michaels et al. | 15/111 |
| 1,421,478 | A | * | 7/1922 | Hope | 15/111 |
| D117,933 | S | | 12/1939 | Manchester et al. | D4/118 |
| 2,447,862 | A | | 8/1948 | Kane | 248/685 |
| 2,603,991 | A | | 7/1952 | Oliver | 81/3.55 |
| 3,109,619 | A | | 11/1963 | Krug et al. | 248/690 |
| 4,741,064 | A | | 5/1988 | Riegert et al. | 15/111 |
| 4,757,568 | A | * | 7/1988 | Jones | 15/105 |
| 4,835,812 | A | * | 6/1989 | Su | 15/105 |
| 5,419,000 | A | * | 5/1995 | Amato et al. | 15/111 |
| D366,150 | S | | 1/1996 | Suchomel | D4/116 |
| 5,575,030 | A | | 11/1996 | Girard | 15/105 |

FOREIGN PATENT DOCUMENTS

DE 2602223 * 7/1977

OTHER PUBLICATIONS

Derwent publication 1999–181335 relating to 1997AU–0007932, published Jan. 1999.*

* cited by examiner

*Primary Examiner*—Mark Spisich

(57) ABSTRACT

A paintbrush and can opener combination includes an elongated handle that has a first end and a second end. The second end includes an elongated forward edge. A plurality of bristles is attached to and extends away from the forward edge. An elongated plate has an attached end and a free end. The attached end is positioned within the handle and attached thereto such that the plate extends outwardly from the first end of the handle. The plate has a bend therein positioned generally between the free end and the handle.

5 Claims, 1 Drawing Sheet

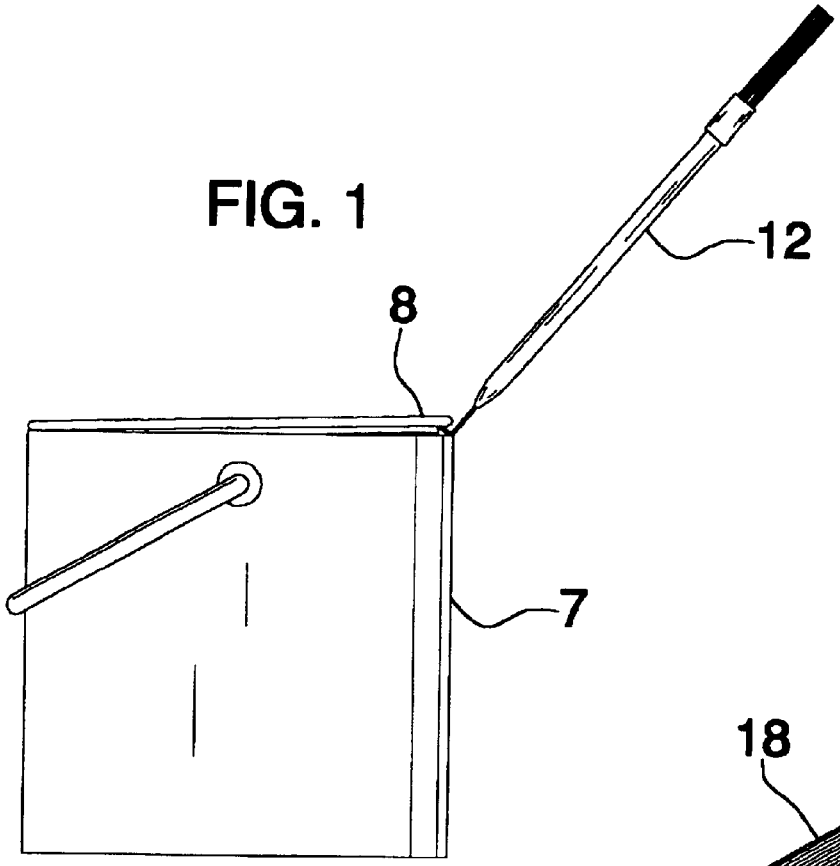
FIG. 1
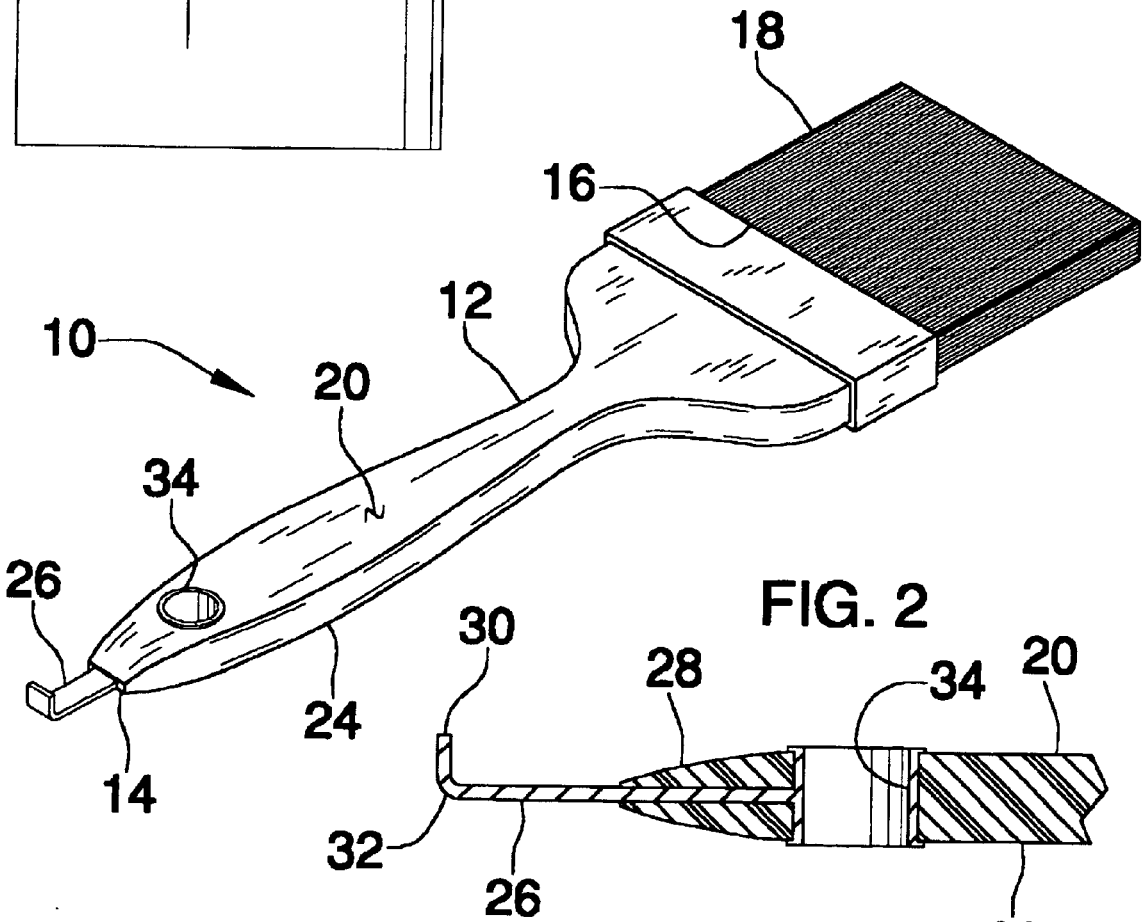
FIG. 2
FIG. 3

PAINTBRUSH AND CAN OPENER COMBINATION

BACKGROUND OF THE INVENTION

1. Field of the Invention

The present invention relates to paintbrush devices and more particularly pertains to a new paintbrush device for providing a combination of a paintbrush and tool for opening a paint can.

2. Description of the Prior Art

The use of paintbrush devices is known in the prior art. Some of these devices, such as U.S. Pat. Nos. 2,603,994 and 5,575,030 include a tool for aiding a person in opening a paint can. While these device fulfill their respective, particular objectives and requirements, the need remains for a device that provides for a better tool for opening a paint can lid.

SUMMARY OF THE INVENTION

The present invention meets the needs presented above by generally comprising an elongated handle that has a first end and a second end. The second end includes an elongated forward edge. A plurality of bristles is attached to and extends away from the forward edge. An elongated plate has an attached end and a free end. The attached end is positioned within the handle and attached thereto such that the plate extends outwardly from the first end of the handle. The plate has a bend therein positioned generally between the free end and the handle. The plate forms a lid key for opening a paint can lid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side environmental view of a paintbrush and can opener combination according to the present invention.

FIG. 2 is a schematic perspective view of the present invention.

FIG. 3 is a schematic cross-sectional view of the first end of the handle of the present invention.

DESCRIPTION OF THE PREFERRED EMBODIMENT

With reference now to the drawings, and in particular to FIGS. 1 through 3 thereof, a new paintbrush device embodying the principles and concepts of the present invention and generally designated by the reference numeral 10 will be described.

As best illustrated in FIGS. 1 through 3, the paintbrush and can opener combination 10 generally comprises an elongated handle 12 that has a first end 14 and a second end 16. The second end 16 includes an elongated forward edge. A plurality of bristles 18 is attached to and extends away from the forward edge, or second end 16. The handle 12 has a top surface 20, a bottom surface 22 and a peripheral edge 24.

An elongated plate 26 has an attached end 28 and a free end 30. The attached end 28 is positioned within the handle 12 and attached thereto such that the plate 26 extends outwardly from the first end 14 of the handle 12. The plate 26 has a bend 32 therein positioned generally between the free end 30 and the handle 12. The bend 32 is substantially equal to ninety degrees. A line extending between the free end 30 and the bend 32 is orientated substantially perpendicular to a plane of the top surface 20. The plate 26 extends generally between ¼ and 2 inches away from the handle 12. The plate 26 has a length from the bend 32 to the free end 30 generally between ¼ inch and 1 inch. The plate 26 is comprised of a rigid metallic material such as, for example, steel.

A loop member 34 is mounted in the handle 12 and extends through the top 20 and bottom 22 surfaces of the handle. The loop member 34 is positioned adjacent to the first end 14 of the handle 12. The loop member 34 comprises a metallic material which is preferably the same material of which the plate 26 is constructed. The loop member 34 is integrally coupled to the attached end 28 of the plate 26.

In use, the paintbrush 12 is used as a conventional paintbrush used for painting. The loop member 34 may be used as a ring for hanging the combination 10 on a vertical surface and as an anchor for the plate 26. The plate 26 is used for lifting a cover 8 up from a paint can 7 as shown in FIG. 1. This will prevent the need for a tool, such as a screwdriver, for lifting the cover 8 from the can 7.

With respect to the above description then, it is to be realized that the optimum dimensional relationships for the parts of the invention, to include variations in size, materials, shape, form, function and manner of operation, assembly and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paintbrush and can opener combination device comprising:

an elongated handle having a first end and a second end, said second end including an elongated forward edge, a plurality of bristles being attached to and extending away from said forward edge, said handle having a top surface, a bottom surface and a peripheral edge;

an elongated plate having an attached end and a free end, said attached end being positioned within said handle and attached thereto such that said plate extends outwardly from said first end of said handle, said plate having a bend therein positioned generally between said free end and said handle said bend being substantially equal to ninety degrees, a line extending between said free end and said bend being orientated substantially perpendicular to a plane of said top surface; and a loop member being mounted in said handle and extending through said top and bottom surfaces of said handle, said loop member being positioned adjacent to said first end of said handle, said loop member comprising a metallic material, said loop member being integrally coupled to said attached end of said plate.

2. The device according to claim 1, wherein said plate extends generally between ¼ and 2 inches away from said handle.

3. The device according to claim 2, wherein said plate has a length from said bend to said free end generally between ¼ inch and 1 inch.

4. The device according to claim 1, wherein said plate has a length from said bend to said free end generally between ¼ inch and 1 inch.

5. A paintbrush and can opener combination device comprising:

an elongated handle having a first end and a second end, said second end including an elongated forward edge, a plurality of bristles being attached to and extending away from said forward edge, said handle having a top surface, a bottom surface and a peripheral edge;

an elongated plate having an attached end and a free end, said attached end being positioned within said handle and attached thereto such that said plate extends outwardly from said first end of said handle, said plate having a bend therein positioned generally between said free end and said handle, said bend being substantially equal to ninety degrees, a line extending between said free end and said bend being orientated substantially perpendicular to a plane of said top surface, said plate extending generally between ¼ and 2 inches away from said handle, said plate having a length from said bend to said free end generally between ¼ inch and 1 inch; and a loop member being mounted in said handle and extending through said top and bottom surfaces of said handle, said loop member being positioned adjacent to said first end of said handle, said loop member comprising a metallic material, said loop member being integrally coupled to said attached end of said plate.

* * * * *